United States Patent [19]

Zumeta

[11] Patent Number: 4,936,170

[45] Date of Patent: Jun. 26, 1990

[54] COLOR CODING SYSTEM

[76] Inventor: Roberto G. Zumeta, 13343 Scamp Dr., Cypress, Tex. 77429

[21] Appl. No.: 386,345

[22] Filed: Jul. 28, 1989

[51] Int. Cl.[5] ..... B25B 13/58

[52] U.S. Cl. ..... 81/180.1; 81/DIG. 5; 116/335; 206/376

[58] Field of Search ..... 81/121.1, 119, 180.1, 81/DIG. 5; 116/335; 206/376–378

[56] References Cited

U.S. PATENT DOCUMENTS 1,719,077 7/1929 Ogsbury ..... 116/335

OTHER PUBLICATIONS

Jensen Fall Catalog, p. 104; "Hollow Shaft Nutdrivers", 1977.

BAHCO Tools Catalog, p. 22; "Socket Wrench Sets", 5/22/86.

*Primary Examiner*—James G. Smith

*Attorney, Agent, or Firm*—Robert W. B. Dickerson

[57] ABSTRACT

A color coding system primarily for implements including tools or other hand-manipulated devices, whereby individual colors are applied to tools of a series having diverse sizes, such diversity of size following an orderly scheme, such as having like denominators with incremental numerator differences.

3 Claims, 1 Drawing Sheet

| DENOMINATOR | SIZE | COLOR |
|---|---|---|
| 16 | 1/16, 3/16, 5/16, 7/16, 9/16, 11/16, 13/16, 15/16, 1 1/16 | YELLOW |
| 8 | 1/8, 3/8, 5/8, 7/8, 1 1/8 | GREEN |
| 4 | 1/4, 3/4, 1 1/4 | BLUE |
| 2 | 1/2, 1 1/2 | RED |
| 1 | 1, 2, 3 | BLACK |

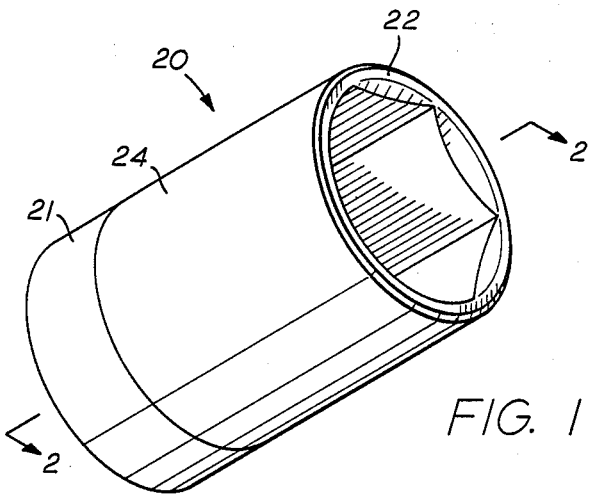
FIG. 1
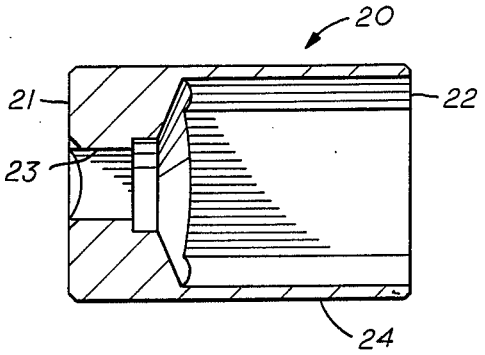
FIG. 2
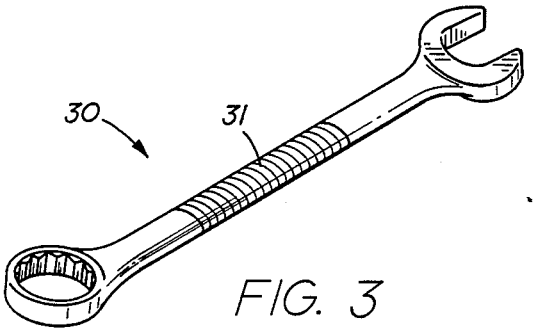
FIG. 3
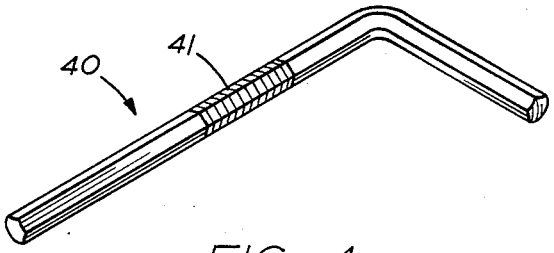
FIG. 4
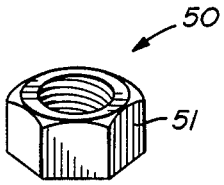
FIG. 5
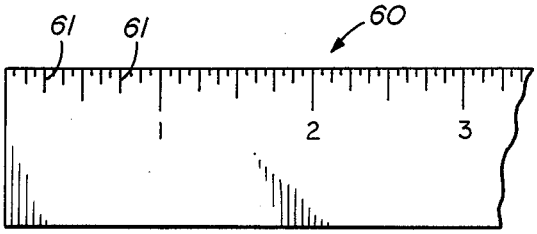
FIG. 6
FIG. 7
| DENOMINATOR | SIZE | COLOR |
|---|---|---|
| 16 | $\frac{1}{16}$, $\frac{3}{16}$, $\frac{5}{16}$, $\frac{7}{16}$, $\frac{9}{16}$, $\frac{11}{16}$, $\frac{13}{16}$, $\frac{15}{16}$, $1\frac{1}{16}$ | YELLOW |
| 8 | $\frac{1}{8}$, $\frac{3}{8}$, $\frac{5}{8}$, $\frac{7}{8}$, $1\frac{1}{8}$ | GREEN |
| 4 | $\frac{1}{4}$, $\frac{3}{4}$, $1\frac{1}{4}$ | BLUE |
| 2 | $\frac{1}{2}$, $1\frac{1}{2}$ | RED |
| 1 | 1, 2, 3 | BLACK |

COLOR CODING SYSTEM

BACKGROUND OF THE INVENTION

Tools, especially hand tools, come in an abundance of forms and sizes. For example, in addition to regular hand wrenches, there are socket, ratchet and set screw key Allen Wrench) varieties. Each such tool comes in a variety of sizes. A worker may carry in his tool box a number of sizes of a number of different such implements.

While most hand tools have some operative size marked thereon, the actual size difference may be so slight that the user may have to read the size on a number of objects to find the appropriate sized tool. Obviously, this takes time. This inventor determined that the presence of a color scheme applied to tools, implements, fasteners, or measuring devices, could significantly reduce the amount of time necessary to select the properly sized instrument. A search performed revealed the following U.S. Pat. Nos., none of which significantly approaches this invention: 3,127,986; 3,749,233; 3,804,238; 3,910,412; 4,032,008; 4,155,446; 4,621,738; and 4,688,672.

SUMMARY OF THE INVENTION

This invention permits ready size discrimination by a tool user. A set of particular tools, the ignition wrench of FIG. 3 being an example, may have a number of differently sized pieces on each end. For example the jaw separation of the convential wrench portion (the nominal size) approximates the width across flats of nuts or bolt heads with which the wrench is suited to be used. The nominal sizes of a kit may vary from ¼" to 2". As a simplistic example, assume that it is desirable to be able to quickly select a 1" conventional wrench. If all wrenches having a size of one or more exact inches were of the same color, a user could easily visually distinguish between the 1" and 2" wrenches. Likewise, if all such devices sized in multiples of ½", excepting those to the even inch, were of another color, again selectivity would be simple. The same concept is applied to sizes having other denominators.

DESCRIPTION OF THE DRAWINGS

FIG. 1 is a perspective of socket wrench;

FIG. 2 is a section taken along lines 2 2 of FIG. 1;

FIG. 3 is a perspective of an ignition or combination wrench having oppositely disposed grip jaws and ratchet;

FIG. 4 is a perspective of an Allen wrench or set screw key;

FIG. 5 is a perspective of a nut;

FIG. 6 is a broken elevation of a rule; and

FIG. 7 is a chart for coordinating size and color.

DESCRIPTION OF A PREFERRED EMBODIMENT

The fundamental goal of this invention is to permit a worker, or tool user, to quickly select the properly sized tool. The term implement is more generic and is intended to include tools, instruments and utensils. This invention allows him to make such a selection from what may be a large collection of differently sized tools in his tool compartment or box. The invention has applicability to a variety of driving as well as driven elements.

Applicability to the metric system will discussed hereinafter. Initial consideration is given to the English or non-metric system.

The crux of the invention comprises the provision of a scheme or system applying specific colors to implements, including tools, fasteners, or similar items, whose effective size varies by clearly defined increments. For example, consider the socket wrench 20 of FIGS. 1 and 2. Such devices typically have a driven portion 21 and a driving portion 22, herein shown to be of ratchet or sawtooth configuration. The driven portion 21, shown to have a square aperture 23 therein, would receive a shaft or handle, to cause rotation thereof. Driving or ratchet portion 22 may vary in size, let's say, from 1/16" to 1", in increments of 1/16", and above 1"in increments of 1". Such nominal size would generally refer to or have a relationship to a fastener such as a nut or bolt head intended to be rotated by the wrench. A specific color, black for example, would be applied to an obvious portion 24 of each socket wrench whose size is 1"or a multiple thereof. At the lower end of the size list, such a wrench having a 1/16" size might have its surface 24 colored yellow. Other sized wrenches having the same denominator, 16, and even numerator increments above "1", i.e., 3/16", 5/16", 7/16"". . . , would also be colored yellow. Likewise, wrenches so sized with the denominator "9", and numerators commencing with "1", and further even increments therefrom, i.e., ⅛", ⅜", ⅝", . . . , may be colored green. Similar treatment would be given sizes whose denominator is "4"or "2", The chart of FIG. 7 illustrates this concept. Such chart may be provided a user as a quick, easy learning tool. The same principal may be applied to the combination wrench 30 of FIG. 3, with the color code applied to a central section 31. Since each end may vary independently, separate color areas may be provided near each end. Likewise, Allen Wrench or set screw key 40 may come in a variety of sizes, with color coding applied at 41. As an additional illustration, nut 50 may have its color applied along one or more of its flats 51. Another example, rule 60, although not strictly a tool in the sense of those shown in FIGS. 1–4 may have its divisional markings, such as ¼", ¾", 61 colored in the same sense as previously described, for quick coordination and determination of size.

Finally, consider the chart of FIG. 7 as illustrative of the mathematical basis of the color code explained previously. The denominator column is self illustrative. The size column depicts a limited number of sizes, wherein the numerator follows the formula 1, and thereafter 1+increments of 2. Finally, the color column specifies the color associated with each collection of sizes. Obviously, other denominator units, with their respective colors could be added. The actual size would likely be printed, preferably in white, on each tool.

For use with metric system tools, similar schemes could be used. For example odd-unit sizes could be designated one color, and even-numbered ones given another, in simplistic fashions. Or, for standard sizes, such as 10 centimeter, 25 centimeter, or the like, similar color codes to those illustrated for non-metric tools could be applied.

Although only a limited number of system embodiments has been illustrated, it should be obvious that numerous modifications would be possible by one skilled in the art without departing from the spirit of the invention, the scope of which is intended to be limited only by the following claims.

I claim:

1. In a set of tools having a color coding mechanism the improvement comprising:

said set includes a plurality of tool groups, each group having a plurality of differently-sized, individual tools, each tool within a particular group having a size which bears a defined mathematical relationship to the size of every other tool within said particular group; and each said tool group includes a distinct color arrangement provided its tools, each said tool group color arrangement being different from that of each of the other tool groups.

2. The set of tools of claim 1 wherein said defined mathematical relationship comprises a common denominator when said tools' sizes are each expressed as a fraction.

3. The set of tools of claim 2 wherein the numerator of each said tool size expressed as a fraction varies from such numerator of each other tool within its respective group.

* * * * *